US007486288B2

(12) United States Patent
Kojima

(10) Patent No.: US 7,486,288 B2
(45) Date of Patent: Feb. 3, 2009

(54) DISPLAY DEVICE DRIVING APPARATUS AND DISPLAY DEVICE USING THE SAME

(75) Inventor: Hidekazu Kojima, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 593 days.

(21) Appl. No.: 10/553,378

(22) PCT Filed: Dec. 7, 2004

(86) PCT No.: PCT/JP2004/018533

§ 371 (c)(1),
(2), (4) Date: Oct. 14, 2005

(87) PCT Pub. No.: WO2005/055188

PCT Pub. Date: Jun. 16, 2005

(65) Prior Publication Data

US 2006/0244706 A1 Nov. 2, 2006

(30) Foreign Application Priority Data

Dec. 8, 2003 (JP) ..... 2003-408376

(51) Int. Cl.
*G09G 5/00* (2006.01)
*G09G 3/36* (2006.01)

(52) U.S. Cl. ..... 345/211; 345/87; 345/90; 345/95; 345/98; 345/212; 345/213; 323/369

(58) Field of Classification Search ..... 323/318, 323/352, 353, 364, 369; 345/55, 84, 87, 345/90, 94, 95, 98, 204, 211, 212, 213
See application file for complete search history.

(56) References Cited

U.S. PATENT DOCUMENTS 5,343,221 A 8/1994 Arakawa et al.
5,627,457 A * 5/1997 Ishiyama et al. ..... 323/318
5,814,981 A * 9/1998 Tsuchi et al. ..... 323/369
6,342,782 B1 1/2002 Yamaguchi et al.
6,426,670 B1 * 7/2002 Tanaka ..... 327/541
7,289,116 B2 * 10/2007 Tanaka ..... 345/211

FOREIGN PATENT DOCUMENTS

JP 03-251817 11/1991
JP 04-143791 5/1992
JP 05-119297 5/1993
JP 09-203885 8/1997

(Continued)

*Primary Examiner*—My-Chau T Tran
(74) *Attorney, Agent, or Firm*—Keating & Bennett, LLP

(57) ABSTRACT

In a drive unit for use with a matrix type display, a buffer circuit of the power supply circuit of the drive unit has an high-voltage first output circuit and a low-voltage second output circuit for generating the same output voltage under a normal operating condition, wherein the high-voltage output circuit has enhanced capability of providing output current to bring up the output voltage and the low-voltage output circuit has enhanced capability of providing output current to bring down the output voltage. A voltage detected at a node connected to the output end of the buffer circuit is compared with a bias voltage. Based on the comparison, the outputs of the first and second output circuits are switched over from one to the other as it is supplied to the display.

7 Claims, 11 Drawing Sheets

FOREIGN PATENT DOCUMENTS

| | | |
|---|---|---|
| JP | 09-292596 | 11/1997 |
| JP | 2000-20147 | 1/2000 |
| JP | 2000-132147 | 5/2000 |
| JP | 2002-156935 | 5/2002 |
| JP | 2002-169501 | 6/2002 |
| JP | 2003-345311 | 12/2003 |
| WO | WO00/41028 | 7/2000 |

* cited by examiner

FIG. 3.A
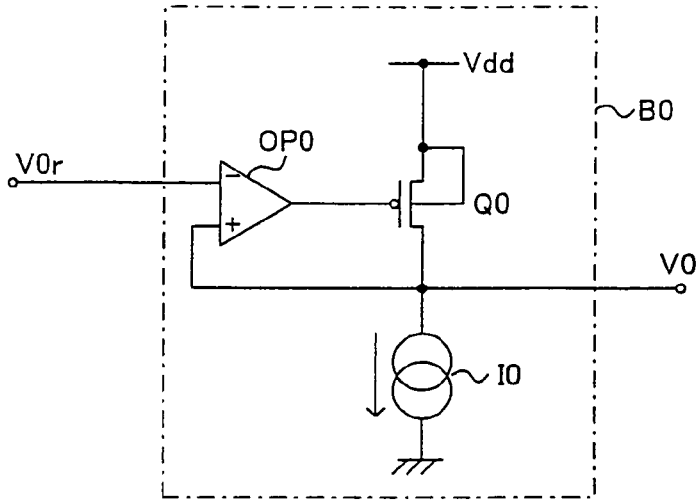
FIG. 3.B
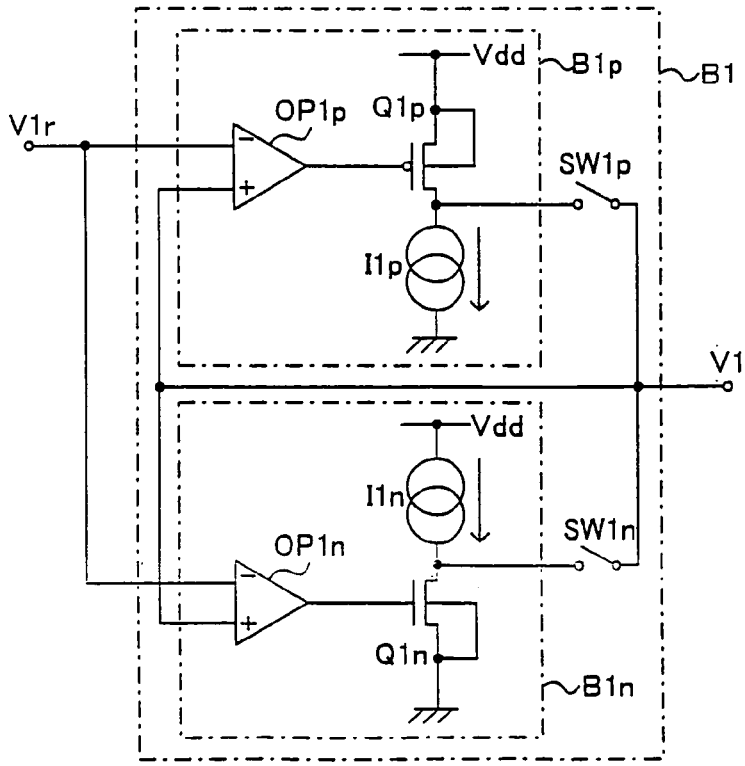

FIG. 3.C
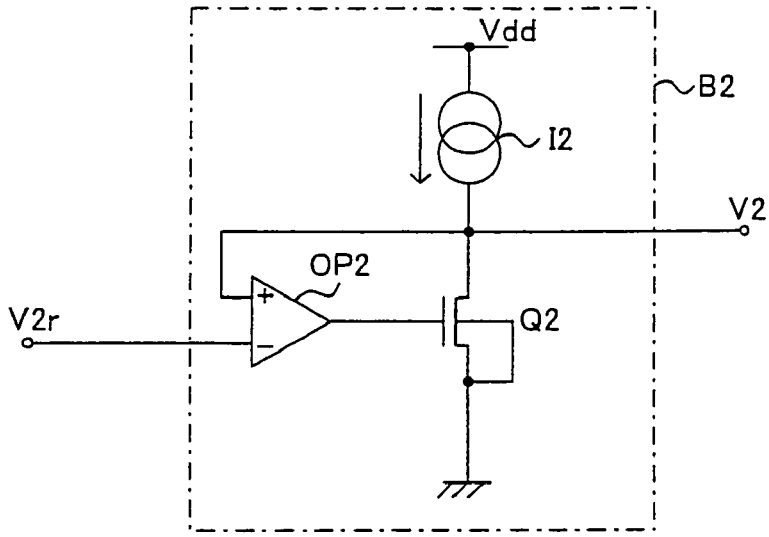
FIG. 3.D
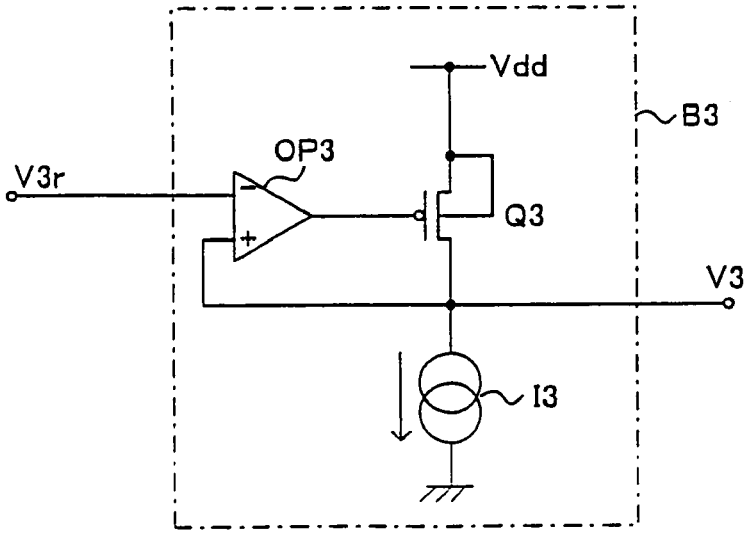

FIG. 3.E
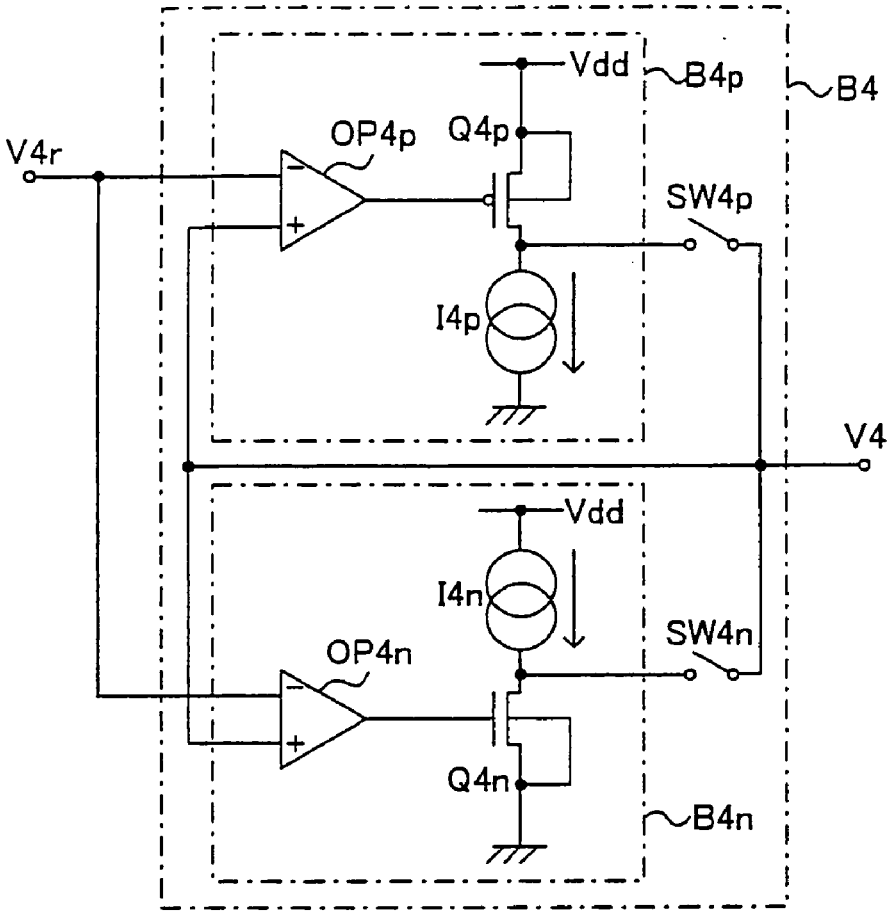

FIG. 4.A
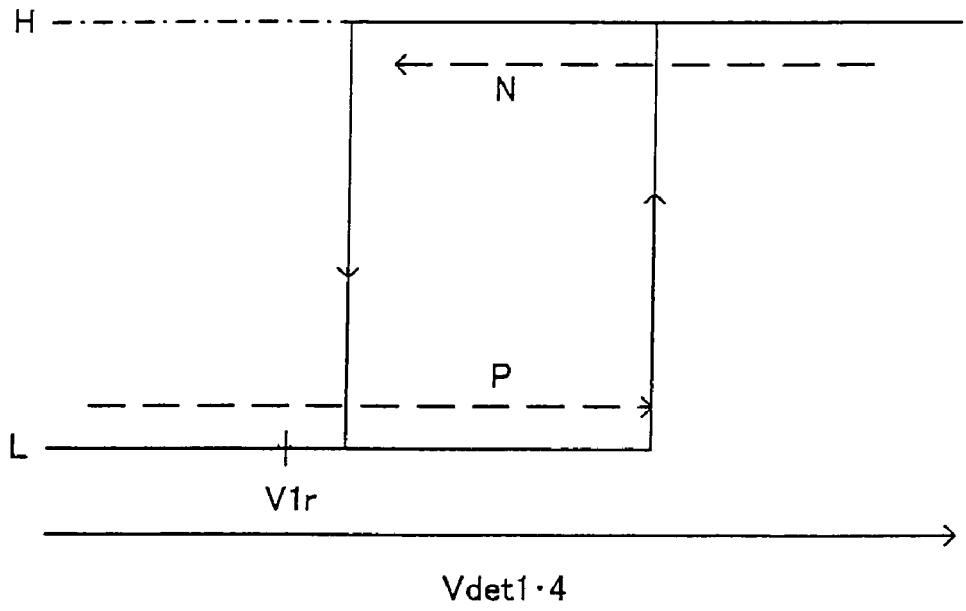
FIG. 4.B
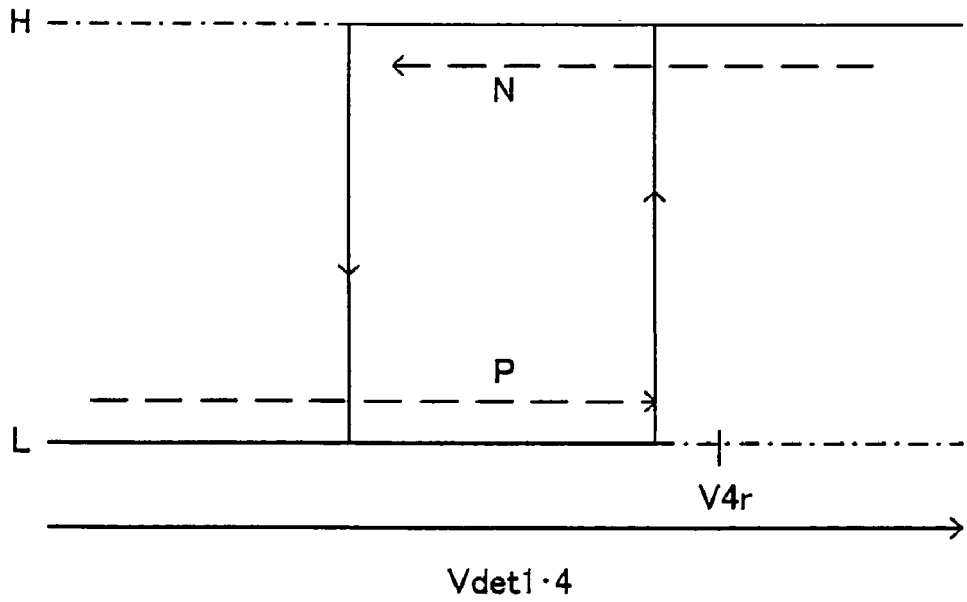

FIG. 7.A
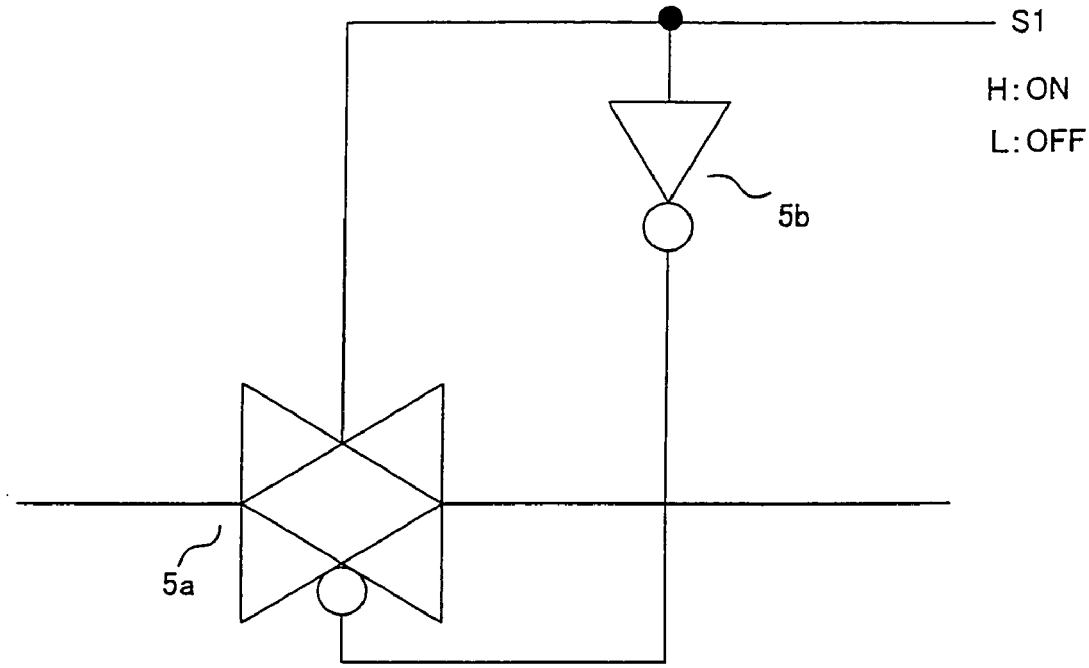
FIG. 7.B
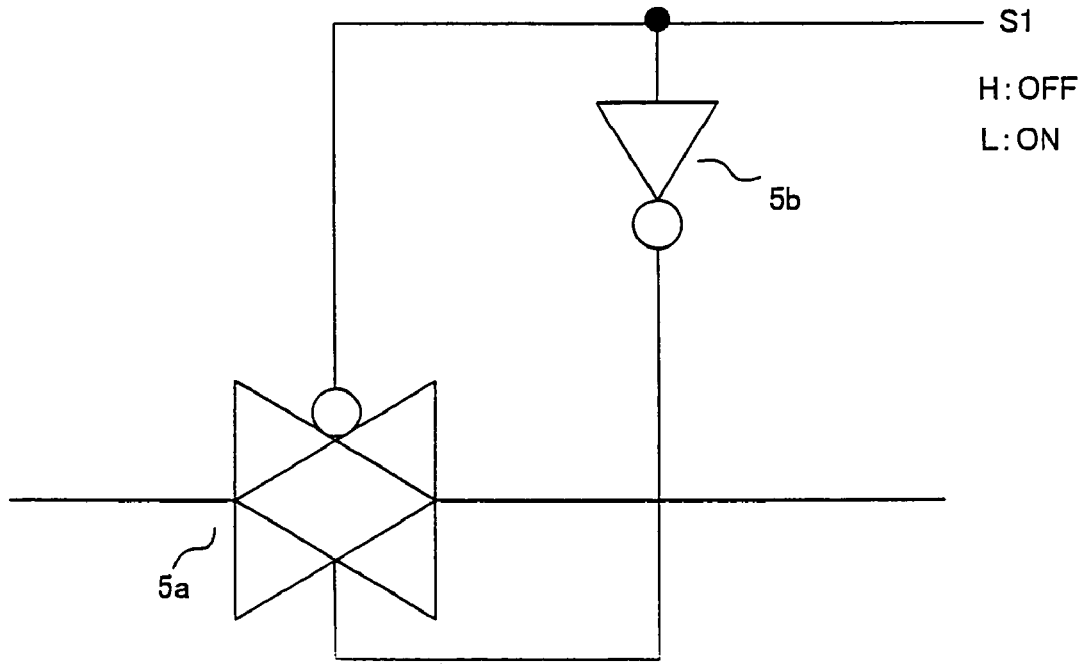

DISPLAY DEVICE DRIVING APPARATUS AND DISPLAY DEVICE USING THE SAME

FIELD OF THE INVENTION

This invention relates to a display drive unit suitable for a matrix type liquid crystal display (LCD) for example, and to a display utilizing such display drive unit.

BACKGROUND OF THE INVENTION

Matrix type LCDs having multiple rows of striping electrodes (referred to as scanning electrodes or common electrodes) and multiple columns of electrodes (referred to signaling electrodes or segment electrodes) arranged perpendicular to the scanning electrodes have been widely used as means for displaying information in dot presentation.

A picture is displayed on such an LCD display by applying a scanning voltage to the respective scanning electrodes in turn and simultaneously applying a signaling voltage to the multiple signaling electrodes. Liquid crystal elements (LCES) are formed at the intersections of the scanning electrodes and the signaling electrodes one for each intersection.

Each of the LCEs is controlled to have a specific transparency determined by an applied effective voltage for a predetermined period of time (one frame period) required to scan all the scanning electrodes once. This scanning provides a desired picture on the display for each frame period.

Referring to FIG. 8, there is shown a circuit arrangement of a conventional display drive for an LCD. The display drive generates first through sixth output voltages V0, V1, V2, V3, V4, and V5, respectively, to be supplied to the LCD. It should be understood that voltages represent potentials with respect to the ground potential unless otherwise stated. The LCD includes a display panel, a scanning drive circuit for sequentially scanning the scanning electrodes, and a signaling drive circuit for applying a signal voltage to the respective signaling electrodes in synchronism with the scanning.

A step-up circuit CHP comprises of a charge pump circuit, which is adapted to receive a supply voltage Vcc from a battery and a clock signal clk and step up the voltage Vcc to a step-up supply voltage Vdd.

The supply voltage Vdd is supplied to a voltage amplifier A1 together with a reference voltage Vref to obtain a first bias voltage V0*r* by amplifying the reference voltage Vref by a predetermined factor. The first bias voltage V0*r* is then divided by resistors R0-R4 to obtain second through fifth bias voltages V1*r*-V4*r*, respectively.

The first through the fifth bias voltages V0*r*-V4*r* are respectively input to a first through a fifth buffer circuits B0-B4 operating at the supply voltage Vdd, each of which outputs the same voltage V0-V4 as the respective input voltage V0*r*-V4*r*. The sixth voltage V5 has the ground potential.

Of these output voltages V0-V5, the first, second, fifth, and sixth output voltages V0, V1, V4, and V5 are supplied to the scanning drive circuit of the LCD. The first, third, fourth, and sixth output voltages V0, V2, V3, and V5 are supplied to the signaling drive circuit. These output voltages are selected and used in synchronism with an alternation signal FR of the LCD. In what follows the alternation signal FR will be described for one frame period.

FIG. 9 illustrates typical waveforms of drive voltages applied to a particular set of scanning electrode COMj and signaling electrode SEGk of an LCD having n scanning electrodes and m signaling electrodes.

In odd numbered frames (for which FR being high (H)), scanning electrodes COM1-COMn are scanned to sequentially select one scanning electrode, COMj say, at a time. The selected scanning electrode COMMj is supplied with the first output voltage V0. The rest of the scanning electrodes COM1-COMn (excluding COMj) are supplied with the fifth output voltage V4. On the other hand, the signaling electrodes SEG1-SEGm are supplied with either the fourth voltage V3 or the sixth voltage V5 in accord with the display signal associated with the selected scanning electrode selected.

Similarly, in the even numbered frames (for which FR being low (L)), the scanning electrodes COM1-COMn are scanned to sequentially select one scanning electrode at a time. The selected electrode COMj, say, is supplied with the sixth voltage V5. The rest of the scanning electrodes COM1-COMn excluding COMj are supplied with the second output voltage V1. On the other hand, signaling electrodes SEG1-SEGm are supplied with either the first output voltage V0 or the third output voltage V2 in accord with the display signal associated with the selected scanning electrode selected.

In this way, under the alternation control of the display elements, a picture defined by the display signal is displayed on the LCD.

Each of the display elements of the LCD functions as a capacitive element. As a consequence, when the voltage of a signaling electrode changes, the voltage of the scanning electrode associated with the signaling electrode varies, exhibiting a noise voltage. This voltage variation causes crosstalks, resulting in degradation of the quality of the displayable picture displayed.

As a measure against such voltage variations, a power supply unit for use with an LCD drive is disclosed in a reference WO00/41028 (Reference 1). This unit comprises: two voltage-follower type differential amplifiers each receiving a pair of a first and a second voltages NV and PV, respectively; an N-type transistor output circuit driven by one of the two differential amplifiers; and a P-type transistor output circuit driven by the other one of the differential amplifiers.

This power supply unit is also provided with separate charging and discharging operational amplifiers for driving liquid crystal display elements. JPA H9-292596 (Reference 2) and JPA H9-203885 (Reference 3) disclose a power supply circuit for use in an LCD drive adapted to switch between two operational amplifiers at the timing of charging and discharging by means of a switching circuit and a timing circuit generating a timing pulse for the switching.

However, in the power supply unit of reference 1 the pair of voltages NV and PV to be supplied to the two differential amplifiers have different magnitudes, that is, there is an offset between them, so that the power supply unit has a dead band in which both of the differential amplifiers become inoperable. It is noted that the voltage at the output node of the output circuit is detected. Hence, the voltage variation (or noise) that has taken place on the display electrode is greatly damped by a selector (voltage selection switch) of the drive circuit before it is detected at the output node of the output circuit. For this reason, the voltage variation (noise) on the display electrode cannot be detected accurately.

In the output circuits of references 2 and 3, charging and discharging operational amplifiers are switched by a timing signal. Thus, additional circuit means for generating the timing signal is necessary. Further, these drive units cannot control the switching to suppress the voltage variation.

It is, therefore, an object of the present invention to provide a display drive unit suitable for driving, for example, a matrix type LCD, the drive unit adapted to detect the voltage near the display panel and including a first output circuit having enhanced capability of providing output current to bring up its output voltage and a second output circuit having enhanced capability of providing output current to bring down its output voltage and capable of switching between the two output circuits without any dead band, thereby reducing crosstalks in, and hence improving the picture quality of, the display panel.

SUMMARY OF THE INVENTION

In accordance with one aspect of the invention, there is provided a drive unit for driving a display having display elements arranged in a matrix (the unit hereinafter referred to as display drive unit and the display elements referred to as matrix type display elements), the display drive unit comprising:

a resistive voltage-dividing circuit for dividing a display reference voltage into multiple bias voltages;

multiple buffer circuits for respectively converting the multiple bias voltages into output voltages through impedance conversion of the bias voltages;

a scanning drive circuit adapted to select from the output voltages of the multiple buffer circuits a voltage to be applied to the scanning electrodes of the matrix type display elements and apply the selected voltage to the scanning electrodes; and a signaling drive circuit adapted to select from the output voltages of the multiple buffer circuits a voltage to be applied to the signaling electrodes of the matrix type display elements and apply the selected voltage to the signaling electrodes, wherein at least one of the multiple buffer circuits includes:

a first output circuit receiving the bias voltage supplied to the buffer circuit and the output voltage of the buffer circuit, and having enhanced drive capability of providing output current to bring up the output voltage;

a first output switch for allowing the first output circuit to output its power;

a second output circuit receiving the bias voltage supplied to the buffer circuit and the output voltage of the buffer circuit, and having enhanced drive capability of providing output current for bringing down the output voltage;

a second output switch for allowing the second output circuit to output its power; and a voltage comparator for comparing the bias voltage supplied to the buffer circuit with the voltage detected at a node connected to the output end of the buffer circuit (the node will be referred to as detection node and the voltage referred to as detection voltage), the voltage comparator adapted to switch between the first and second output switches in accord with the comparison.

The voltage comparator preferably has a hysteresis characteristic. The voltage range of the hysteresis may be set not to include the bias voltage.

In accordance with another aspect of the invention, there is provided a display drive unit for driving a display having matrix type display elements, the display drive unit comprising:

a resistive voltage-dividing circuit for dividing a display reference voltage into multiple bias voltages;

multiple buffer circuits for respectively converting the multiple bias voltages into output voltages through impedance conversion of the bias voltages;

a scanning drive circuit adapted to select a voltage to be applied to the scanning electrodes of the matrix type display elements from the output voltages of the multiple buffer circuits and apply the selected voltage to the scanning electrodes; and a signaling drive circuit adapted to select from the output voltages of the multiple buffer circuits a voltage to be applied to the signaling electrodes of the matrix type display elements and apply the selected voltage to the signaling electrodes, wherein one of the multiple buffer circuits (referred to as high-voltage buffer circuit) includes:

a first output circuit receiving the bias voltage supplied to the high-voltage buffer circuit and the output voltage of the high-voltage buffer circuit, and having enhanced drive capability of providing output current to bring up the output voltage;

a first output switch for allowing the first output circuit to output its power;

a second output circuit receiving the bias voltage supplied to the high-voltage buffer circuit and the output voltage of the high-voltage buffer circuit, and having enhanced drive capability of providing output current for bringing down the output voltage;

a second output switch for allowing the second output circuit to output its power; and a first voltage comparator for comparing the bias voltage supplied to the high-voltage buffer circuit with the voltage obtained by detecting the voltage applied to the display elements not in display mode (the voltage referred to as detection voltage), the voltage comparator adapted to switch between the first and second output switches in accord with the comparison. Further, another one of the multiple buffer circuits (the buffer circuit hereinafter referred to as low-voltage buffer circuit) includes;

a third output circuit receiving a bias voltage lower than the bias voltage for the high-voltage buffer circuit along with the output voltage of the low-voltage buffer circuit, and having enhance drive capability of providing output current to bring up the output voltage;

a third output switch for allowing the third output circuit to output its power;

a fourth output circuit receiving the bias voltage supplied to the low-voltage buffer circuit and the output voltage of the low-voltage buffer circuit, and having enhance drive capability of providing output current to bring down the output voltage;

a fourth output switch for allowing the fourth output circuit to output its power; and a second voltage comparator for comparing the bias voltage supplied to the low-voltage buffer circuit with the detection voltage, the voltage comparator adapted to switch between the third and fourth output switches in accord with the comparison.

The detection voltage is taken at a node (referred to as detection node) connected to the output end of the high-voltage buffer circuit via a first selection switch and to the output end of the low-voltage buffer circuit via the second selection switch; and either one of the first and second selection switches is selected by an alternation signal.

The first and second voltage comparators preferably have hysteresis characteristics.

The first voltage comparator may have a hysteresis in a region where the detection voltage is slightly above the bias voltage supplied to the high-voltage buffer circuit, while the second voltage comparator may have a hysteresis in a region where the detection voltage is slightly below the bias voltage supplied to the low-voltage buffer circuit.

A display of the invention comprises a matrix type display panel driven by any one of the display drive units as described above.

In an inventive display drive unit suitable for driving a display such as a matrix type LCD, at least one of multiple buffer circuits includes a parallel connection of: a first output circuit having enhanced drive capability of providing output current to bring up the output voltage of the buffer circuit and connected to a first output switch for allowing the first output circuit to output its power; and a second output circuit having enhanced drive capability of providing output current for bringing down the output voltage and connected to a second output switch for allowing the second output circuit to output its power, wherein the first and the second output circuits are supplied with the same bias voltage. Thus, no dead band arises in the operation of the first and the second output circuits, so that the buffer circuit promptly recovers its predetermined output voltage.

The display drive unit of the invention is provided with a voltage comparator for comparing the bias voltage supplied to the buffer circuit with the detection voltage detected at a node connected to the output end of the buffer circuit (or the detection voltage indicative of the voltage applied to a relevant display element not in display mode), and adapted to switch between the first and second output switches based on the comparison, so that the noise contained in the detection voltage is absorbed. As a result, since the output circuit not providing output current is also in a predetermined operational mode, the buffer circuit can provide appropriate output voltage immediately after the first and second output switches are switched from one to the other.

The drive unit of the invention is responsive to a small noise and can promptly absorb it, since the detection voltage is taken at a detection node close to the source of the noise. Thus, crosstalks in the display panel are reduced, thereby improving the picture quality of the display.

Comparison of the output voltages of the inventive output circuits and switching of the outputs thereof can be performed in a stable manner. This can be done by setting up a hysteresis in the voltage comparator of the output circuits, or, in the case where the output circuits include a first and a second voltage comparators, by setting up a first hysteresis in the first voltage comparator in a region where the detection voltage is slightly above the bias voltage of the high-voltage buffer circuit therefor, and a second hysteresis in the second voltage comparator in a region where the detection voltage is slightly below the bias voltage of the low-voltage buffer circuit.

It is noted that a common detection voltage can be used for the high-voltage and low-voltage buffer circuits, so that a single feedback loop can be used for two different voltage comparators. In the inventive display, noise due to crosstalks is reduced, which improves the picture quality of the display.

BRIEF DESCRIPTION OF THE DRAWINGS

FIG. 3.A shows a circuit arrangement of a buffer circuit of the power supply circuit.

FIG. 3.B is a circuit arrangement of another buffer circuit of the power supply circuit.

FIG. 3.C is a circuit arrangement of a still another buffer circuit of the power supply circuit.

FIG. 3.D shows a circuit arrangement of a further buffer circuit of the power supply circuit.

FIG. 3.E is a circuit arrangement of a still further buffer circuit of the power supply circuit.

FIG. 4.A is a graphical representation of an operational characteristic of a first voltage comparator constituting the power supply circuit.

FIG. 4.B is a graphical representation of an operational characteristic of a second voltage comparator constituting the power supply circuit.

FIG. 7.A shows a circuit diagram of an exemplary analog switch.

FIG. 7.B shows a circuit diagram of another exemplary analog switch.

BEST MODE FOR CARRYING OUT THE INVENTION

A display drive unit of the invention and a display utilizing the display drive unit will now be described in detail with reference to accompanying drawings.

Figure 1:
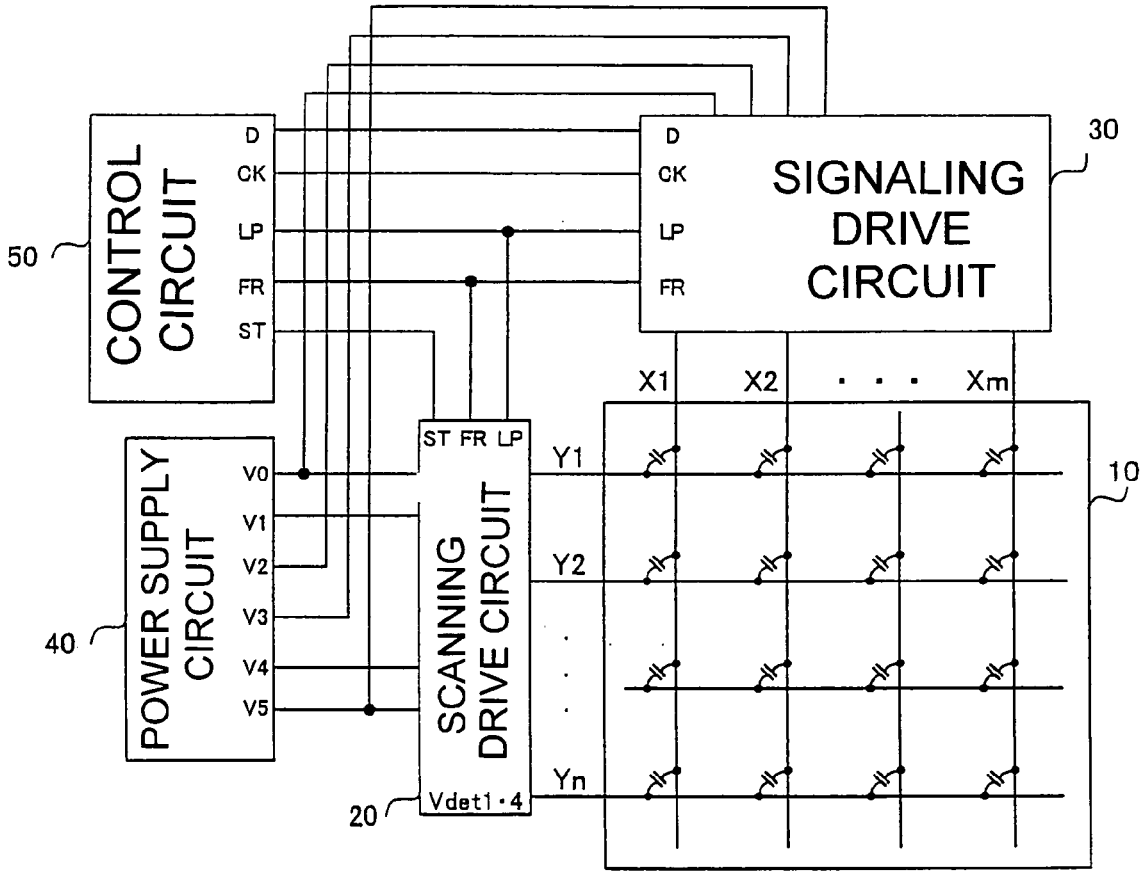
FIG. 1 shows a circuit arrangement of an LCD in accordance with one embodiment of the invention.

Referring to FIG. 1, there is shown a circuit arrangement of an LCD in accordance with one embodiment of the invention. The LCD has a matrix display 10, a drive circuit for scanning (scanning drive circuit) 20, a drive circuit for signaling (signaling drive circuit) 30, a power supply circuit 40, and a control circuit 50. It should be understood that an organic EL display utilizing organic EL elements could be used in place of the LCD.

Figure 2:
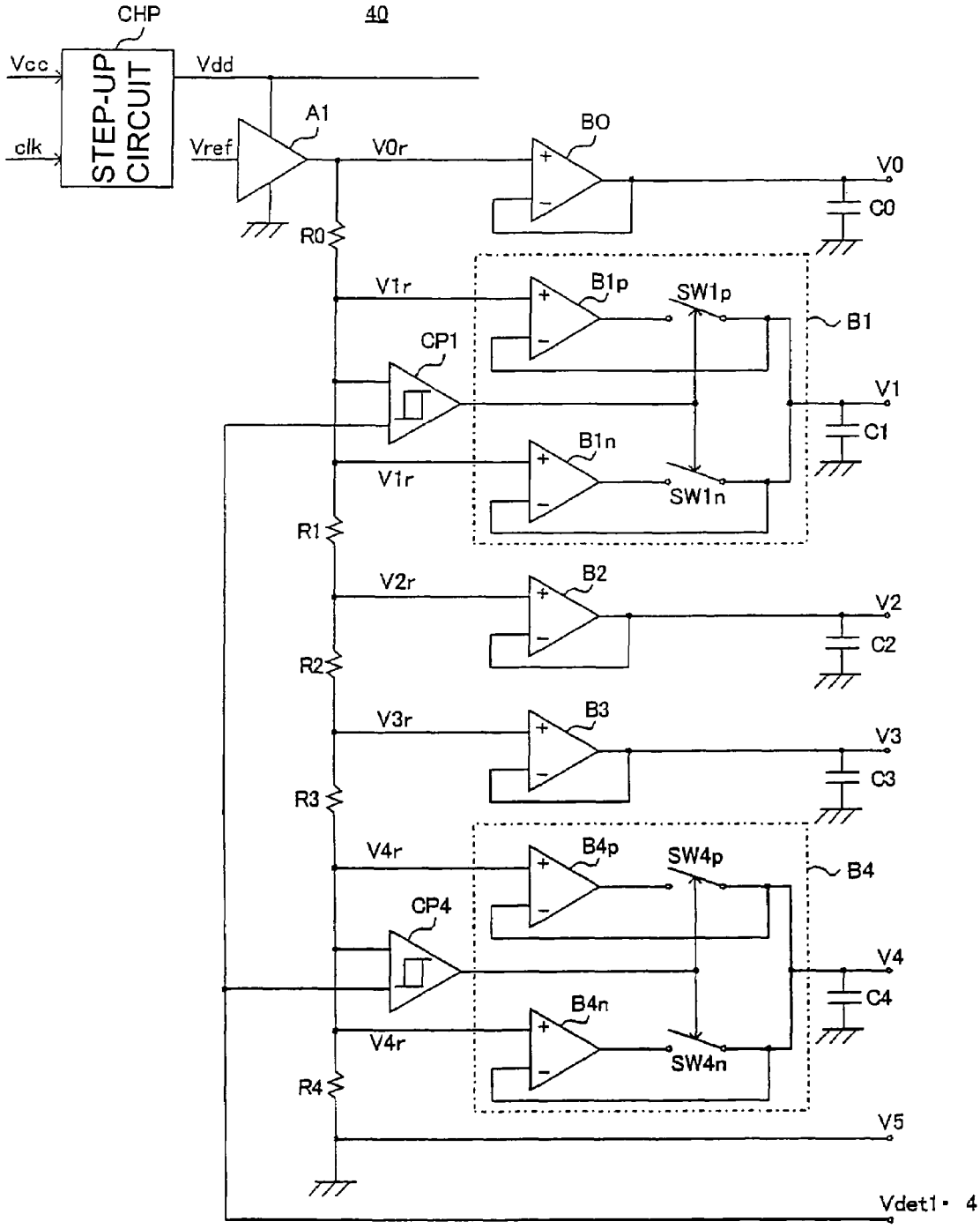
FIG. 2 shows a circuit arrangement of the power supply circuit shown in FIG. 1.

Referring to FIG. 2, there is shown a circuit diagram of the power supply circuit 40. FIGS. 3.A-3.E show circuit arrangements of buffer circuits of the power supply circuit. FIGS. 4.A and 4.B show operational characteristics of voltage comparators of the power supply circuit. FIGS. 7.A and 7.B show circuit diagrams of exemplary analog switches.

As shown in FIG. 1, the display 10 is provided with multiple signaling electrodes (or segment electrodes) X (X1-Xm) and multiple scanning electrodes (or common electrodes) Y (Y1-Yn), the two types of electrodes formed on two facing substrates such that they are perpendicular to each other. The signal and scanning electrodes are respectively formed of about several hundreds of electrodes. Inserted between the respective signaling electrodes X and scanning electrodes Y are liquid crystal display elements of a simple matrix display for example, the LCD elements forming display elements at the respective intersections of the electrodes.

The power supply circuit 40 generates a multiplicity of different voltages (six voltages V0-V5 in this example) necessary for alternation control of the display. These voltages are supplied to either the scanning drive circuit 20 or the signaling drive circuit 30. The voltages V0-V5 are fixed at predetermined levels, respectively, which become smaller (or larger) in magnitude in the order mentioned. The multiplicity of the voltages can be more than six, or less if alternation control is not needed.

The control circuit 50 generates display data D, clocks, and different kinds of control signals, which are supplied to the scanning drive circuit 20 and the signaling drive circuit 30. The display data D include data for controlling signals (e.g. PWM data) to be supplied to the signaling electrodes X1-Xm. The display data D is supplied to the signaling drive circuit 30. The tone of the display 10 is controlled based on the display data D.

A data shifting clock CK, supplied to the signaling drive circuit, is for shifting the display data D. A scanning clock LP serves as a scanning signal for scanning the scanning electrodes Y when it is supplied to the scanning drive circuit 20, and serves as a latch signal for latching the display data D for one line of display data D when supplied to the signaling drive circuit 30. An alternation signal FR is an inverting/non-inverting signal (having a high (H) or a low (L) level) for performing alternation driving of the LCD. When alternation driving is not needed, the alternation signal FR is not required.

A start signal ST is supplied to the scanning drive circuit 20 for starting scanning.

The scanning drive circuit 20 thus receives a start signal ST, a scanning clock LP, and alternation signal FR. Then the scanning drive circuit 20 generates a predetermined scanning voltage to be supplied to the scanning electrodes Y1-Yn in turn to scans these electrodes Y1-Yn at a predetermined clock interval.

Details of the power supply circuit 40 shown in FIG. 2 will now be described. A power supply voltage Vcc input from a battery for example and a clock clk are supplied to a step-up circuit CHP, which outputs a step-up power supply voltage Vdd. The step-up circuit CHP comprises of, for example, a charge pump circuit, and has at the output end thereof a smoothing capacitor for smoothing the power supply voltage Vdd.

The power supply voltage Vdd is supplied to a voltage amplifier A1, which amplifies a reference voltage Vref by a predetermined factor to form a display reference voltage. This display reference voltage serves as a first bias voltage (first reference voltage) V0*r*. The display reference voltage is divided by resistors R0-R4 into a first bias voltage (first reference voltage) V0*r*, a second bias voltage (second reference voltage) V1*r*, a third bias voltage (third reference voltage) V2*r*, a fourth bias voltage (fourth reference voltage) V3*r*, and a fifth bias voltage (fifth reference voltage) V4*r*.

The first through fifth reference voltages V0*r*-V4*r* are respectively input to a first through a fifth buffer circuits B0-B4, which respectively output a first through a fifth output voltages V0-V4, each having the same level as the corresponding reference voltage V0*r*-V4*r*. In the example shown herein, the power supply voltage Vdd higher than the output voltages V0-V4 of the respective buffer circuits is used to drive the buffer circuits B0-B4. Alternatively, the output voltages V0-V3 may be used for the same purpose. The sixth voltage V5 equals the ground potential.

Of these first through sixth voltages V0-V5, the first, second, fifth, and sixth output voltages, V0, V1, V4, and V5, respectively, are supplied to the scanning drive circuit 20 of the LCD. On the other hand, the first, third and fourth output voltages V0, V2, and V3, respectively, and the sixth voltage V5 are supplied to the signaling drive circuit 30 of the LCD. These voltages are selected in synchronism with the alternation signal FR of the LCD, in the manner as described in connection with FIG. 9.

Referring to FIG. 3.A, there is shown a circuit arrangement of the first buffer circuit B0. The first buffer circuit B0 is provided with a P-type MOS transistor Q0 connected between the power supply voltage Vdd and the first output voltage V0, and with a constant-current source I0 for flowing weak current (1 micro-ampere, for example) between the first output voltage V0 and the ground. The constant-current source 10 is provided to stabilize the operation of the buffer circuit. Other constant-current sources used in other buffer circuits are provided for the same purpose.

Also, there is provided an operational amplifier OP0 receiving the first reference voltage V0*r* and the first output voltage V0 to output a control signal to the P-type MOS transistor Q0. In first buffer circuit B0, current flows through the P-type MOS transistor Q0, wherein the P-type MOS transistor Q0 is controlled such that the first output voltage V0 is equilibrated to the first reference voltage V0*r*. Since current flows from the power supply voltage Vdd via the P-type MOS transistor Q0, the first buffer circuit B0 serves as an output circuit having enhanced drive capability of providing output current to bring up the first output voltage V0 if the output voltage V0 has lowered.

FIG. 3.B shows a circuit arrangement of the second buffer circuit B1. The second buffer circuit B1 has a first circuitry that includes a P-type MOS transistor Q1*p* and a first output switch SW1*p* connected in series between, for example, the power supply voltage Vdd and the second output voltage V1. The second buffer circuit B1 also has a second circuit that includes a second output switch SW1*n* and an N-type MOS transistor Q1*n* connected in series between the second output voltage V1 and the ground. A constant-current source I1*p* is provided for flowing weak current between the output end (drain) of the P-type MOS transistor Q1*p* and the ground. Another constant-current source I1*n* is provided for flowing weak current between the power supply voltage Vdd and the output end (drain) of an N-type MOS transistor Q1*n*.

There are provided an operational amplifier OP1*p* receiving the second reference voltage V1*r* and the second output voltage V1 to output a control signal to the P-type MOS transistor Q1*p*, and an operational amplifier OP1*n* receiving the second reference voltage V1*r* and the second output voltage V1 to output a control signal to the N-type MOS transistor Q1*n*. In the second buffer circuit B1, current flows through the P-type MOS transistor Q1*p* when the first output switch SW1*p* is turned on, while current flows through the N-type MOS transistor Q1*n* when the second output switch SW1*n* is turned on. In either case, the P-type and the N-type MOS transistors Q1*p* and Q1*n*, respectively, are controlled to equilibrate the second output voltage V1 with the second reference voltage V1*r*.

The circuitry that includes the P-type MOS transistor Q1*p* and the operational amplifier OP1*p* constitutes a first output circuit B1*p* having enhanced drive capability of providing output current to bring up the second output voltage V1, while the circuitry that includes the N-type MOS transistor Q1*n* and the operational amplifier OP1*n* constitutes a second output circuit B in having enhanced drive capability of providing output current to bring down the second output voltage V1.

In this way, the second buffer circuit B1 has the first circuitry having the first output circuit B1*p* and the first output switch SW1*p* to acquire enhanced drive capability of providing output power to bring up its output voltage and the second circuitry having the second output circuit B1*n* and the second output switch SW1*n* to acquire enhanced drive capability of providing output power to bring down its output voltage, with the first and second output circuits connected together in parallel and receiving the same reference voltage V1*r*. Thus, no dead band will arise in the operation of the first and second output circuits B1*p* and B1*n*, respectively.

It is noted that the first output switch SW1*p* and the second output switch SW1*n* are controlled by a first voltage comparator CP1 as shown in FIG. 2 such that the two switches SW1*p* and SW1*n* are exclusively turned on and off in accordance with the output of the first comparator CP1. The first voltage comparator CP1 has a hysteresis characteristic. For example, when the second output voltage V1 is raised from a lower level as controlled by the first voltage comparator CP1, the first output switch SW1*p* is turned on. On the other hand, when the second output voltage V1 is lowered from a higher level, the second output switch SW1*n* is turned on.

The first voltage comparator CP1 may be provided in the second buffer circuit B1 as a part thereof.

Since the first output voltage V0 has a higher voltage than the second output voltage V1, the first output voltage V0 may be utilized, in place of the power supply voltage Vdd, as the operational power source for the second buffer circuit B1 and the first voltage comparator CP1. Similarly, instead of the power supply voltage Vdd, an output voltage of one buffer circuit may be utilized as the operational power source of another buffer circuit if the former buffer circuit has a higher output voltage than the latter.

FIG. 3.C shows a circuit arrangement of the third buffer circuit B2. The third buffer circuit B2 has an N-type MOS transistor Q2 connected between the third output voltage V2 and the ground, and a constant-current source I2 for flowing weak current between the power supply voltage Vdd and the third output voltage V2. The third buffer circuit B2 also has an operational amplifier OP2 for generating and supplying a control signal to the N-type MOS transistor Q2.

In the third buffer circuit B2, current flows through an N-type MOS transistor Q2, wherein the n-type MOS transistor Q2 is controlled in such a way that the third output voltage V2 is equilibrated to the third reference voltage V2*r*. Since current flows from the third output voltage V2 into the third buffer circuit B2, allowing the current to flow through the N-type MOS transistor Q2, the third buffer circuit B2 serves as an output circuit having enhance drive capability of providing output current to bring down third output voltage V2.

FIG. 3.D shows a circuit arrangement of the fourth buffer circuit B3. The fourth buffer circuit B3 is similar in structure to the first buffer circuit B0, receiving as its reference voltage the fourth output voltage V3*r* and providing the fourth output voltage V3.

FIG. 3.E shows a circuit arrangement of the fifth buffer circuit B4. The fifth buffer circuit B4 is similar in structure to the second buffer circuit B1 of FIG. 3.B, receiving the fifth reference voltage V4*r* as its reference voltage and providing the fifth output voltage V4. As a result, the circuitry that includes the P-type MOS transistor Q4*p* and the operational amplifier OP4*p* constitutes a third output circuit B4*p* having enhanced drive capability of providing drive current to bring up the fifth output voltage V4. The circuitry that includes the N-type MOS transistor Q4*n* and the operational amplifier OP4*n* constitutes a fourth output circuit B4*n* having enhanced drive capability of providing drive current to bring down the fifth output voltage V4. A constant-current source I4*p* is provided for flowing weak current between the output end (drain) of the P-type MOS transistor Q4*p* and the ground, and a constant-current source I4*n* for flowing weak current between the power supply voltage Vdd and the output end (drain) of an N-type MOS transistor Q4*n*.

It is noted that the third output switch SW4*p* and the fourth output switch SW4*n* are controlled by the second voltage comparator CP4 such that the two output switches SW4*p* and SW4*n* are exclusively turned on and off in accord with the output of the comparator CP4. The second voltage comparator CP4 has a hysteresis characteristic. For example, when the fifth output voltage V4 is raised from a lower level as controlled by the second voltage comparator CP4, the third output switch SW4*p* is turned on. On the other hand when the fifth output voltage V4 is lowered from a higher level, the fourth output switch SW4*n* is turned on.

The second voltage comparator CP4 may be provided in the fifth buffer circuit B4 as a part thereof.

The first voltage comparator CP1 is supplied with the second reference voltage V1*r* and a detection voltage Vdet1·4 that is supplied to the display elements not in display mode, and compares the magnitudes of these voltages. The second voltage comparator CP4 is supplied with the fifth reference voltage V4*r* and the detection voltage Vdet1·4, and compares these voltages.

Incidentally, in the scanning drive circuit 20, either the second output voltage V1 or the fifth output voltage V4 is selected by a common voltage selection switch (analog switch) in accordance with the level (H or L) of the alternation signal FR. The selected voltage is supplied to the respective scanning electrodes Y1-Yn via a non-selective scanning switch. The detection voltage Vdet1·4 refers to the voltage that is selected by the analog switch for application to the scanning electrodes Y1-Yn. That is, the detection voltage Vdet1·4 is the voltage applied to the display elements not in display mode (either the second output voltage V1 or the fifth output voltage V4.) Therefore, the detection voltage Vdet1·4 is close to the voltage actually applied to the scanning electrodes Y1-Yn. For this reason, the detection voltage Vdet1·4 reflects the voltage variation (noise) on the scanning electrodes Y1-Yn more accurately without being much influenced by the voltage drops (attenuation) caused by analog switches. A node providing the detection voltage Vdet1·4 will be referred to as detection node.

FIG. 4.A shows the operational characteristic of the first voltage comparator CP1 as a function of the detection voltage Vdet1·4. In the example shown in FIG. 4.A, the output of the first comparator CP1 remains low (L) while the detection voltage Vdet1·4 is lower than a level which is slightly (3 mV for example) larger than the second reference voltage V1*r*. As a consequence, the first output switch SW1*p* is normally turned on, thereby causing the first output circuit B1*p* to output the second output voltage V1. As a consequence, when the detection voltage Vdet1·4 changes from the fifth output voltage V4 to the second output voltage V1, current will flow out of the first output circuit B1*p* without any time lag due to switching.

When the detection voltage Vdet1·4 exceeds a level higher than the second reference voltage V1*r* by a predetermined voltage (20 mV for example), the output voltage of the first voltage comparator CP1 is pulled up to H level, thereby turning on the second output switch SW1*n*. This causes current to flow into the second output circuit B1n, which absorbs noise of positive polarity.

In order to allow smooth switching of the first and second output switches SW1*p* and SW1*n*, respectively, the first voltage comparator CP1 preferably has a hysteresis of about 20 mV in width. The hysteresis may be set up, in a region slightly above the second reference voltage V1*r*, to have a predetermined width, ranging from V1*r*+α (e.g. α=3 mV) to V1*r*+β (e.g. β=20 mV).

FIG. 4.B shows an operational characteristic of the second voltage comparator CP4 as a function of the detection voltage Vdet1·4. This detection voltage Vdet1·4 is the same as used for the first voltage comparator CP1. The output voltage of the second voltage comparator CP4 remains high (H) while the detection voltage Vdet1·4 is higher than a level which is slightly lower than the fifth reference voltage V4*r*, as shown in FIG. 4.B. As a consequence, the fourth output switch SW4*n* is normally turned on, thereby causing the fourth output circuit B4*n* to output the fifth output voltage V4. As a consequence, when the detection voltage Vdet1·4 changes from the second output voltage V1 to the fifth output voltage V4, current will flow into the fourth output circuit B4*n* without any time lag due to switching.

When the detection voltage Vdet1·4 is lower than a level below the fifth reference voltage V4*r* by a predetermined voltage (20 mV for example), the output level of the second voltage comparator CP4 is pulled down to L level, thereby turning on the third output switch SW4*p*. This causes current to flow out of the third output circuit B4*p*, absorbing noise having a negative polarity.

In order to allow smooth switching of the third and fourth output switches SW4*p* and SW4*n*, respectively, the second voltage comparator CP4 preferably has a hysteresis. The hysteresis may be set up, in a region slightly below the fifth reference voltage V4*r*, to have a predetermined width.

Figure 5:
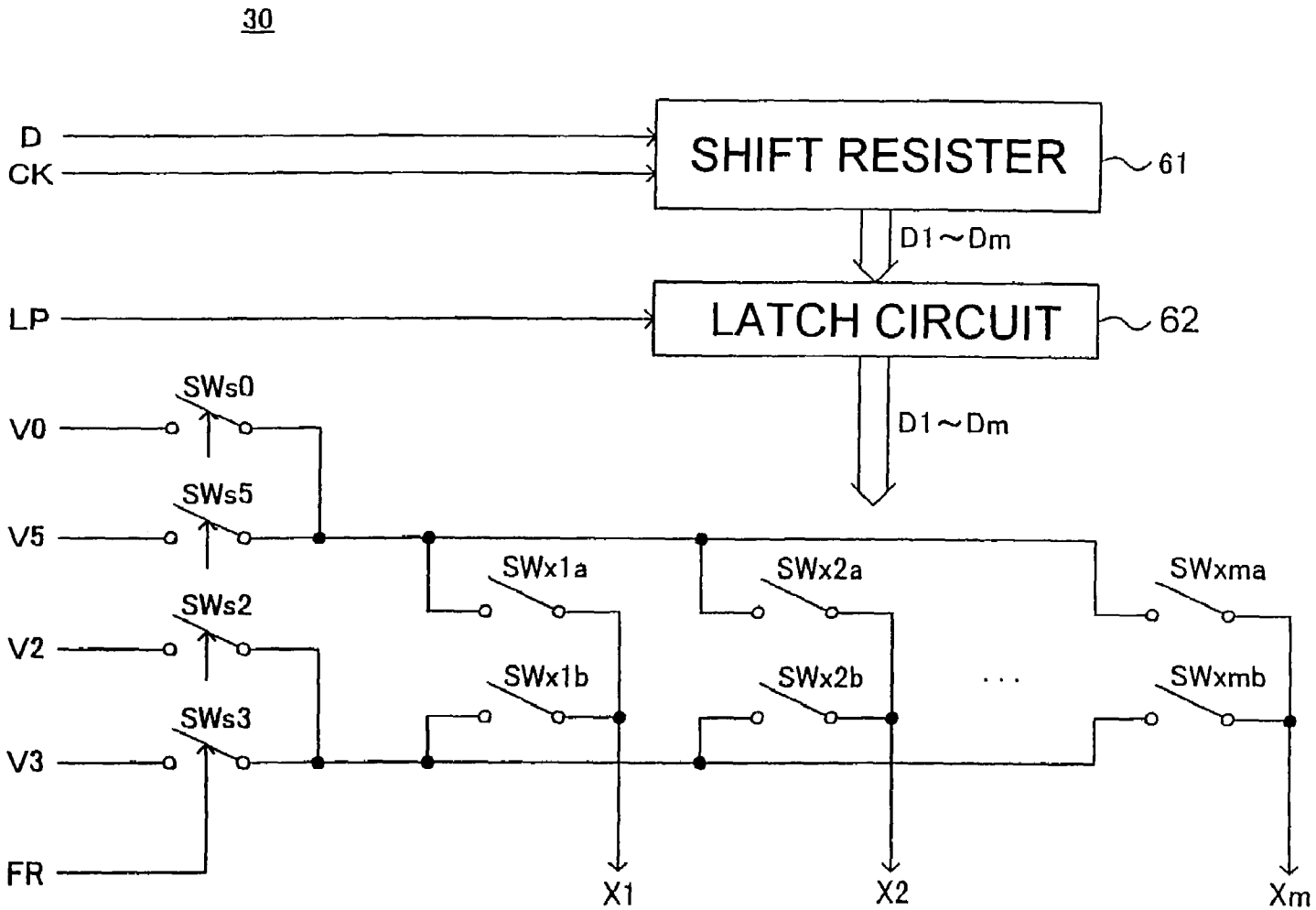
FIG. 5 shows a circuit arrangement of a signaling drive circuit.

FIG. 5 shows a circuit arrangement of the signaling drive circuit 30. As shown in FIG. 5, display data D is supplied to a shift register 61 in sequence and in synchronism with a data shifting clock CK in a data shifting operation. Display date D for one line (D1-Dm) is latched in a latch circuit 62 in response to a scanning clock LP.

Each of the signaling electrodes X1-Xm is provided with a pair of one "latch data" switch Swx1*a*-SWxma that is turned on when data to be latched exist and one "null data" switch SWx1*b*-SWxmb that is turned off when no such data exists. Either the switch SWx1*a*-SWxma or the switch SWx1*b*-SWxmb is turned on according to the display data D (D1-Dm) latched.

The first output voltage V0 is supplied to the switches SWx1*a*-SWxma via a segment voltage selection switch SWs0, or the sixth voltage V5 is supplied to the switches SWx1*a*-SWxma via a segment voltage selection switch SWs5. The third output voltage V2 is supplied to the null-data switches SWx1*b*-SWxmb via a segment voltage selection switch SWs2, or the fourth output voltage V3 is supplied to the null-data switches SWx1*b*-SWxmb via a segment voltage selection switch SWs3.

The segment voltage selection switches SWs5 and SWs3 are selected for odd numbered frames when the alternation signal FR is high (H). The segment voltage selection switches SWs0 and SWs2 are selected for even numbered frames when the alternation signal FR is low (L). Thus, as is the case with the scanning electrode COMj shown in FIG. 9, odd numbered frames are supplied with either the sixth voltage V5 or the fourth output voltage V3, in accord with the relevant display data, while even numbered frames are supplied with either the first output voltage V0 or the third output voltage V2.

Figure 6:
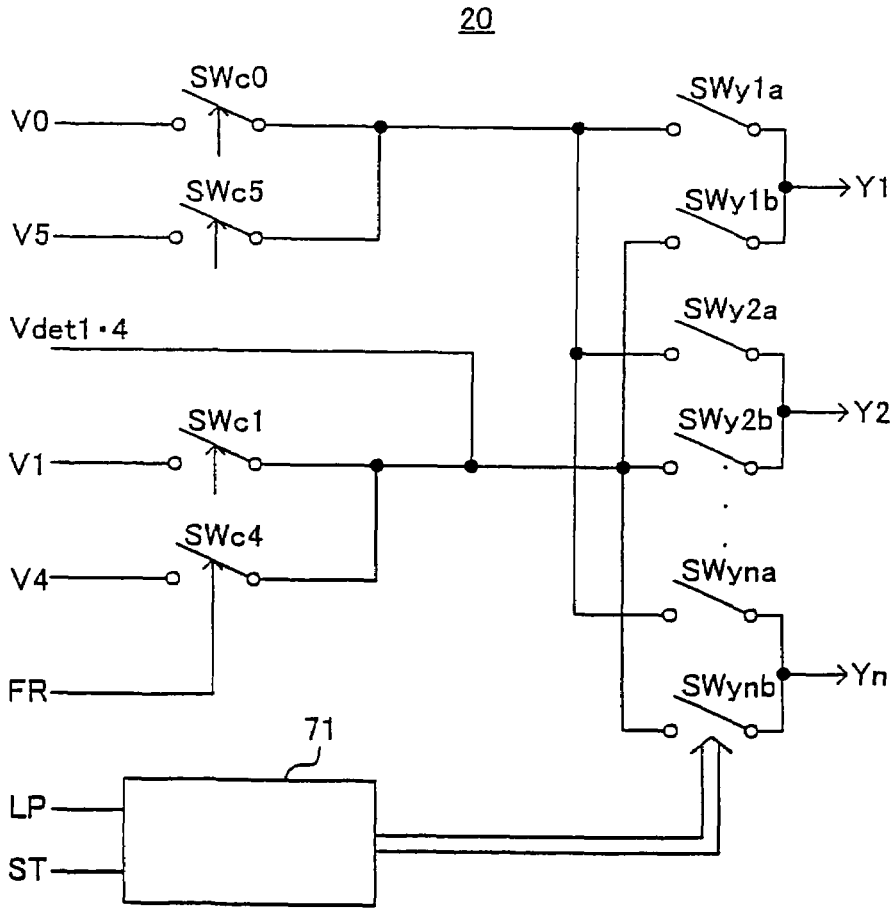
FIG. 6 shows a circuit arrangement of a scanning drive circuit
Figure 8:
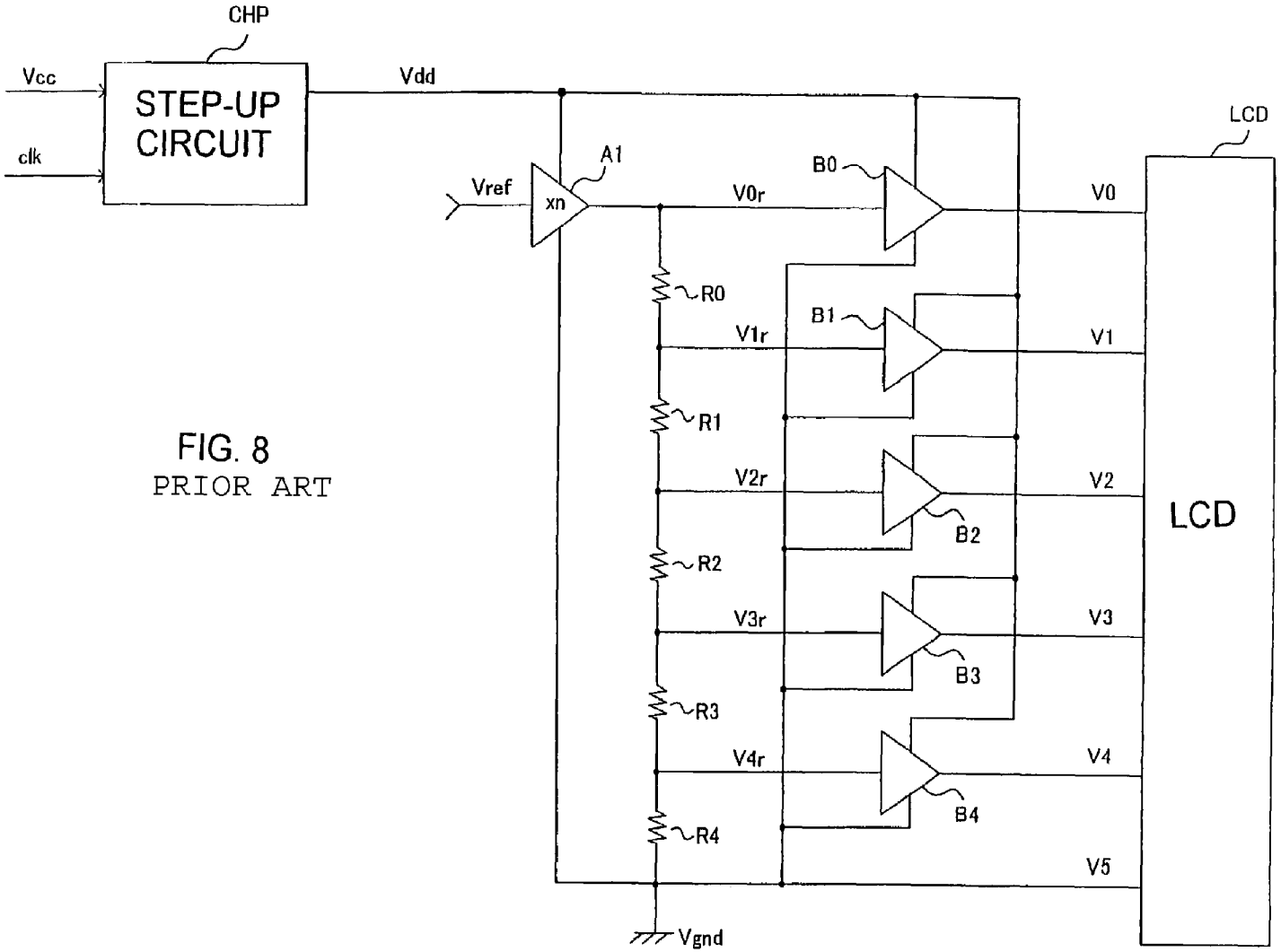
FIG. 8 PRIOR ART
FIG. 8 shows a circuit arrangement of a conventional power supply unit.

FIG. 6 shows a circuit arrangement of the scanning drive circuit 20. As shown in FIG. 6, the first output voltage V0 is applied to selection scanning switches SWy1*a*-SWyna via a common voltage selection switch SWc0, and the sixth voltage V5 is applied to the selection scanning switches SWy1*a*-SWyna via a common voltage selection switch SWc5. The second output voltage V1 is supplied to non-selection scanning switch SWy1*b*-SWynb via a common voltage selection switch SWc1, and the fifth output voltage V4 is supplied to the non-selection scanning switch SWy1*b*-SWynb via a common voltage selection switch SWc4.

The selection switches SWc0 and SWc4 are selected for odd numbered frames when the alternation signal FR is high (H). On the other hand, the selection switches SWc5 and SWc1 are selected for the even numbered frames when the alternation signal FR is low (L).

Each of the scanning electrodes Y1-Yn is provided with a pair of one selection scanning switch SWy1*a*-SWyna and one non-selection scanning switch Swy1*b*-SWynb.

Upon receipt of a scanning clock LP following a start signal ST, a scanning circuit 71 sequentially turns on the selection scanning switches SW1*a*-SWyna, one at a time.

Figure 9:
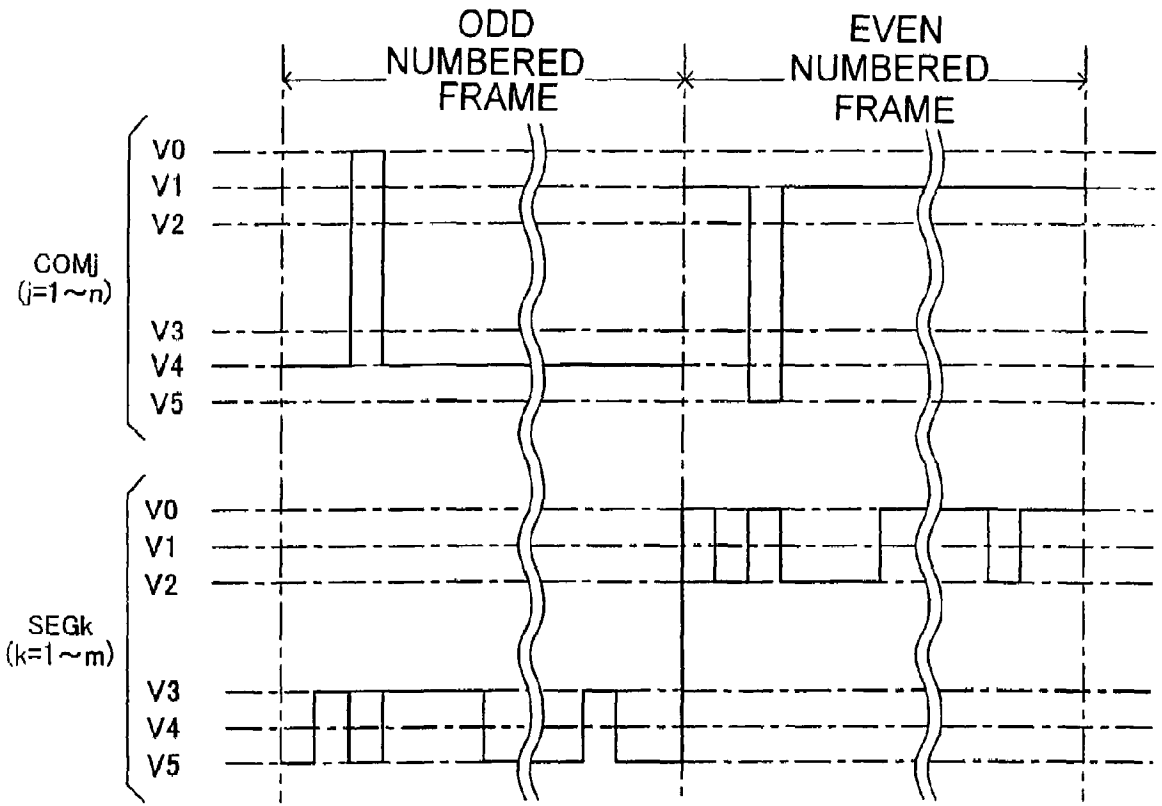
FIG. 9 PRIOR ART
FIG. 9 shows waveforms of drive signals for use with a liquid crystal display panel.

Thus, as in the case with the scanning electrode COMj shown in FIG. 9, only one scanning electrode is selectively pulled up to the first output voltage V0 in the odd numbered frames, while the rest of the scanning electrodes are supplied with the fifth output voltage V4. In the even numbered frames, only one of the scanning electrodes is selectively pulled up to the sixth voltage V5 and the rest of the scanning electrodes are supplied with the second output voltage V1.

In the scanning drive circuit 20, the position (node) to which the non-selection scanning switch SWy1*b*-SWynb are connected, that is, the position from where the second output voltage V1 or the fifth output voltage V4 is supplied via the common voltage selection switch SWc1 or common voltage selection switch SWc4, is taken to be the node where the detection voltage Vdet1·4 is detected.

FIGS. 7.A and 7.B respectively show circuit arrangements of an analog switch suitable for flowing bi-directional current.

This analog switch comprises a CMOS transistor 5*a* consisting of a P-type MOS transistor connected in series with an N-type transistor, an inverter 5*b* having an output terminal connected to one input terminal of the CMOS transistor 5*a*, and a control signal line S1 that is connected to the other input terminal of the CMOS transistor 5*a* and to the input terminal of the inverter 5*b*. The analog switch shown in FIG. 7.A is turned on when the control signal line S1 is at H level and turned off when the control signal line is at L level. The analog switch shown in FIG. 7.B is turned on when the control signal line S1 is at L level and turned off when the control signal line is at H level.

This analog switch may be used as a switch for selecting a common voltage selection switch SWc0-SWc5, segment voltage selection switch SWs0-SWs5, a signaling electrode, and a scanning electrode.

In the power supply circuit 40 shown in FIG. 2, the first and third output switches SW1*p* and SW4*p*, respectively, are P-type MOS transistor switch circuits, while the second and fourth output switches SW1*n* and SW4*n*, respectively, are N-type MOS transistor switch circuits.

Referring to the accompanying drawings, operation of the inventive display will now be described in detail.

The first through sixth voltages V0-V5 output from the power supply circuit 40 are supplied to the scanning drive circuit 20 and to the signaling drive circuits 30 as previously described. The detection voltage Vdet1·4 is fed back from the detection node of the scanning drive circuit 20 to the first and second voltage comparators CP1 and CP4, respectively, of the power supply circuit 40.

Under this condition, a start signal ST, display data D, a clock CK, a scanning clock LP, and an alternation signal FR are supplied from the control circuit 50 to the scanning drive circuit 20 and the signaling drive circuit 30. As a result, the scanning electrodes Y1-Ym are scanned and the signal data D (D1-Dm) are supplied to the signaling electrodes X1-Xm to display a picture on the display 10 in accord with the display data D.

In this operation, it is preferable that each of the scanning electrodes and each of the signaling electrodes are supplied with predetermined output voltages. However, since each of the display elements functions as a capacitive element, the voltages of the scanning electrodes Y1-Yn fluctuate, exhibiting a noise, in response to the changes in voltage of the associated signaling electrodes.

Looking at the scanning of electrodes associated with the common voltage selection switches SWc1 and SWc4, a scanning electrode in the odd numbered frames held at the first output voltage V0 at a moment will undergo a sudden change in voltage to the fifth output voltage V4 in the next moment. On the other hand, a signaling electrode undergoes a change to the fourth and sixth output voltages V3 and V5, respectively. As a consequence, the voltage at the node of the common voltage selection switches SWc1 and SWc4 (fifth output voltage V4 in this example) connected to the scanning electrodes cannot be held at the predetermined level but fluctuates. These voltage fluctuations cause crosstalks and degrade the picture quality of the display. This is also the case with the even numbered frames: the voltage of scanning electrodes connected to the common voltage selection switches SWc1 and SWc4 (which is the second output voltage V1 in this example) cannot be held at the predetermined level and fluctuates. Thus, crosstalks will take place, resulting in degradation of the picture quality of the display.

According to the invention, fluctuations in voltage of the scanning electrodes, that is, fluctuations in the second and fifth output voltages V1 and V4, respectively are promptly suppressed to maintain these voltages at the predetermined levels, thereby reducing resultant crosstalks.

Exemplary arrangements for the reduction of the fluctuations have been described above. Particularly, the detection voltage Vdet1·4 to be compared with reference voltages is detected at a node as close as possible to the scanning electrodes Y1-Yn. Specifically, the detection voltage is taken at a node of the common voltage selection switches SWc1 and SWc4 connected to the scanning electrodes. It is noted that this detection voltage Vdet1·4 is fed back to the first and second voltage comparators CP1 and CP4, respectively.

Accordingly, unlike the prior art power supply unit as disclosed in the reference 1, voltage fluctuations can be detected without being attenuated by the common voltage selection switches SWc1 and SWc4, thereby allowing more accurate detection of the actual voltage. Thus, the voltage comparators CP1 and CP4 can promptly respond to a small noise and allows the display drive unit to provide the output voltages in a stable manner.

The buffer circuit B1 is a high-voltage buffer circuit that includes the first voltage comparator CP1 for comparing the reference voltage V1*r* with the detection voltage Vdet1·4 detected at a detection node connected to the output end of the buffer circuit B1. The first voltage comparator CP1 is configured to have a hysteresis in a range where the detection voltage Vdet1·4 is slightly higher than the reference voltage V1*r* of the buffer circuit B1. Thus, if the scanning electrode held at the sixth voltage V5 at a moment undergoes a sudden change in voltage to the second output voltage V1 in the next moment, switching of the first and second output switches SW1*p* and SW1*n*, respectively, does not take place, thereby allowing the power supply unit to promptly respond to the change.

In the same manner, the low-voltage buffer circuit B4 includes the second voltage comparator CP4 for comparing the reference voltage V4*r* with the detection voltage Vdet1·4 detected at a detection node connected to the output end of the buffer circuit B4. The second voltage comparator CP4 is configured to have a hysteresis in a range where the detection voltage Vdet1·4 is slightly lower than the reference voltage V4*r* of the buffer circuit B4. Thus, if a scanning electrode held at the first voltage V0 at a moment undergoes a sudden change in voltage to the fifth output voltage V4 in the next moment, switching of the third and fourth output switches SW4*p* and SW4*n*, respectively, does not take place, thereby allowing the power supply unit to promptly respond to the change.

Since the first output circuit B1*p* and the second output circuit B1*n* of the high-voltage buffer circuit B1 and the third output circuit B4*p* and the fourth output circuit B4*n* of the low-voltage buffer circuit B4 are in operation at all times, changes in voltage on the scanning electrodes that accompany the changes in voltage (V3→V5, V5→V3, V0→V2, and V2→V0) that has taken place on the associated signaling electrodes can be promptly suppressed.

Because the detection node for the detection voltage Vdet1·4 is taken at the node of the common voltage selection switches SWc1 and SWc4 that is connected to the scanning electrodes, a single feedback loop for feeding back a common detection voltage can be used for two voltage comparators CP1 and CP4 comparing two different voltages. Industrial Applicability

INDUSTRIAL APPLICABILITY

A display drive unit of the invention enables reduction of crosstalks in a matrix type display such as LCD and an organic EL display and improves the picture quality of the display.

The invention claimed is:

1. A display drive unit for driving a display having matrix type display elements, said display drive unit comprising:

a resistive voltage-dividing circuit for dividing a display reference voltage using resistors to generate multiple bias voltages;

multiple buffer circuits for respectively converting said multiple bias voltages into output voltages through impedance conversion of said bias voltages;

a scanning drive circuit adapted to select a voltage to be applied to the scanning electrodes of said matrix type display elements from said output voltages of said multiple buffer circuits and apply the selected voltage to said scanning electrodes; and a signaling drive circuit adapted to select a voltage to be applied to the signaling electrodes of said matrix type display elements from said output voltages of said multiple buffer circuits and apply the selected voltage to said signaling electrodes, wherein at least one of said buffer circuits includes:

a first output circuit receiving the bias voltage supplied to said buffer circuit and the output voltage of said buffer circuit, and having enhanced drive capability of providing output current to bring up said output voltage;

a first output switch for allowing said first output circuit to output its voltage;

a second output circuit receiving the bias voltage supplied to said buffer circuit and the output voltage of said buffer circuit, and having enhanced drive capability of providing output current for bringing down said output voltage;

a second output switch for allowing said second output circuit to output its voltage; and a voltage comparator for comparing the bias voltage supplied to said buffer circuit with the detection voltage detected at a node connected to the output end of said buffer circuit, said voltage comparator adapted to switch between said first and second output switches in accord with the comparison.

2. The display drive unit according to claim 1, wherein said voltage comparator has a hysteresis characteristic.

3. The display drive unit according to claim 2, wherein said hysteresis characteristic is set in a voltage region that does not include said bias voltage.

4. A display drive unit for driving a display having matrix type display elements, said display drive unit comprising:

a resistive voltage-dividing circuit for dividing a display reference voltage using resistors to generate multiple bias voltages;

multiple buffer circuits for respectively converting said multiple bias voltages into output voltages through impedance conversion of said bias voltages;

a scanning drive circuit adapted to select a voltage to be applied to the scanning electrodes of said matrix type display elements from said output voltages of said multiple buffer circuits and apply the selected voltage to said scanning electrodes; and a signaling drive circuit adapted to select a voltage to be applied to the signaling electrodes of said matrix type display elements from said output voltages of said multiple buffer circuits and apply the selected voltage to said signaling electrodes, wherein one of said multiple buffer circuits comprises a high-voltage buffer circuit that includes:

a first output circuit receiving the bias voltage supplied to said high-voltage buffer circuit and the output voltage of said high-voltage buffer circuit, and having enhanced drive capability of providing output current to bring up said output voltage;

a first output switch for allowing said first output circuit to output its voltage;

a second output circuit receiving the bias voltage supplied to said high-voltage buffer circuit and the output voltage of said high-voltage buffer circuit, and having enhanced drive capability of providing output current for bringing down said output voltage;

a second output switch for allowing said second output circuit to output its voltage; and a first voltage comparator for comparing the bias voltage supplied to said high-voltage buffer circuit with the detection voltage in accord with the voltage applied to the display elements not in display mode, said voltage comparator adapted to switch between said first and second output switches in accord with the comparison, and wherein another one of said multiple buffer circuits comprises a low-voltage buffer circuit that includes;

a third output circuit receiving a bias voltage lower than the bias voltage for the high-voltage buffer circuit along with the output voltage of said low-voltage buffer circuit, and having enhanced drive capability of providing output current to bring up said output voltage;

a third output switch for allowing said third output circuit to output its voltage;

a fourth output circuit receiving the bias voltage supplied to said low-voltage buffer circuit and the output voltage of said low-voltage buffer circuit, and having enhance drive capability of providing output current to bring down said output voltage;

a fourth output switch for allowing said fourth output circuit to output its voltage; and a second voltage comparator for comparing the bias voltage supplied to said low-voltage buffer circuit with said detection voltage, said voltage comparator adapted to switch between said third and fourth output switches in accord with the comparison, wherein:

the detection node for said detection voltage is connected to the output end of the high-voltage buffer circuit via a first selection switch and to the output end of the low-voltage buffer circuit via the second selection switch; and either one of said first and second selection switches is selected by an alternation signal.

5. The display drive unit according to claim 4, wherein said first voltage comparator and second voltage comparator respectively have hysteresis characteristics.

6. The display drive unit according to claim 5, wherein said first voltage comparator exhibits a hysteresis in a region where said detection voltage is slightly above the bias voltage supplied to said high-voltage buffer circuit, and said second voltage comparator exhibits a hysteresis in a region where said detection voltage is slightly below the bias voltage supplied to said low-voltage buffer circuit.

7. A display, comprising:

a display drive unit according to any one of claims 1 through 6; and a matrix type display panel driven by said display drive unit.

* * * * *